US007158109B2

(12) United States Patent
Cairns et al.

(10) Patent No.: US 7,158,109 B2
(45) Date of Patent: Jan. 2, 2007

(54) ACTIVE MATRIX DISPLAY

(75) Inventors: Graham Cairns, Oxford (GB); Michael Brownlow, Oxford (GB)

(73) Assignee: Sharp Kabushiki Kaisha, Osaka (JP)

( * ) Notice: Subject to any disclaimer, the term of this patent is extended or adjusted under 35 U.S.C. 154(b) by 454 days.

(21) Appl. No.: 10/236,033

(22) Filed: Sep. 4, 2002

(65) Prior Publication Data

US 2003/0043134 A1 Mar. 6, 2003

(30) Foreign Application Priority Data

Sep. 6, 2001 (GB) ..... 0121524.3

(51) Int. Cl.
*G09G 5/00* (2006.01)

(52) U.S. Cl. ..... 345/90

(58) Field of Classification Search ..... 345/87, 345/90, 94, 96, 100, 103, 208, 209
See application file for complete search history.

(56) References Cited

U.S. PATENT DOCUMENTS

| | | | | | |
|---|---|---|---|---|---|
| 4,866,348 | A * | 9/1989 | Harada et al. | 315/169.3 |
| 4,975,691 | A * | 12/1990 | Lee | 345/79 |
| 5,142,275 | A * | 8/1992 | Rockel | 345/635 |
| 5,250,933 | A * | 10/1993 | Beaudin et al. | 345/635 |
| 5,576,731 | A * | 11/1996 | Whitby et al. | 345/100 |
| 5,598,565 | A * | 1/1997 | Reinhardt | 713/323 |
| 5,751,266 | A * | 5/1998 | Crossland et al. | 345/96 |
| 5,790,090 | A * | 8/1998 | Libsch et al. | 345/94 |
| 5,945,974 | A * | 8/1999 | Sharma et al. | 345/98 |
| 5,949,432 | A * | 9/1999 | Gough et al. | 345/629 |
| 6,057,820 | A * | 5/2000 | Irwin | 345/96 |
| 6,061,043 | A * | 5/2000 | Bonnett et al. | 345/89 |
| 6,614,418 | B1 * | 9/2003 | Koyama et al. | 345/103 |
| 6,973,623 | B1 * | 12/2005 | Little et al. | 715/760 |
| 2002/0175887 | A1 * | 11/2002 | Yamazaki | 345/87 |

FOREIGN PATENT DOCUMENTS

| | | | |
|---|---|---|---|
| CN | 1246238 | A | 3/2000 |
| JP | 401126686 | A * | 5/1989 |
| JP | 06-118942 | | 4/1994 |
| JP | 1218598 | A | 2/1999 |
| WO | WO 97/34414 | | 9/1997 |
| WO | 98/27725 | | 6/1998 |

* cited by examiner

*Primary Examiner*—Amare Mengistu
(74) *Attorney, Agent, or Firm*—Renner, Otto, Boisselle & Sklar, LLP

(57) ABSTRACT

An active matrix display comprises an active matrix array of pixels divided into first and second sets, the pixels 35 of the first set are refreshed in the conventional active matrix way by a first refreshing arrangement M1, 6, 7. Pixels 36 for displaying a graphical feature such as an icon overlaid on the active matrix display image have a second refreshing arrangement M2, 6, 37 to allow the icon pixels of each icon to be switched to the same state, such as maximum back or maximum white. The icon pixels 36 may also have the first refreshing arrangement M1, 6, 7 so that they can be used either as part of the active matrix for displaying arbitrary data or when selected as such, for overlaying the icon image on the arbitrary image data.

36 Claims, 17 Drawing Sheets

ACTIVE MATRIX DISPLAY

BACKGROUND OF THE INVENTION

1. Field of the Invention

The present invention relates to an active matrix display. Such a display may be used, for example, for displaying images and graphical features such as icons in portable battery-operated equipment. Such a display may be sufficient on its own, for example as a reflective display, or may require other components, such as a backlight or a projection system, in order to form a complete display apparatus.

2. Description of the Related Art

FIG. 1 of the accompanying drawings illustrates a typical active matrix display comprising an active matrix 1 of N rows and M columns of picture elements (pixels) 2. Timing, control and data signals are supplied to a display controller 3, which supplies appropriate signals to a data line driver 4 and a scan line driver 5. The data and scan line drivers 4 and 5 provide the appropriate voltages to the electrodes of the pixels 2 via data lines 6 and scan lines 7. In a typical display of this type, each row of image data is supplied to the data line driver 4 and converted into the appropriate pixel voltages which are supplied via the data lines 6 to the columns of pixels. The scan line driver 5 supplies scan signals one at a time in sequence on the scan lines 7 to scan each row of pixel data into the appropriate row of pixels 2. The voltages supplied to the pixels are such as to cause the desired optical response of each pixel.

FIG. 2 of the accompanying drawings illustrates the arrangement of four pixels of the matrix 1. Each pixel comprises a thin film transistor (TFT) 10 which operates as a switch. The TFTs 10 may be implemented as amorphous silicon TFTs or low temperature poly-silicon TFTs, for example. The gate of each TFT 10 is connected to a scan line 7 whereas the source of each TFT 10 is connected to a data line 6. The drain of each TFT 10 is connected to a pixel electrode 11 and to a first electrode of a storage capacitor Cs, whose second electrode is connected to a common line 12 which is common to the second electrodes of the storage capacitors of all of the pixels in the display illustrated in FIG. 2.

The optical elements 13 of the display are illustrated as being liquid crystal elements but other types of element such as organic electroluminescent elements may also be used. The liquid crystal of each pixel is disposed between the pixel electrode 11 and a common electrode 14 with the common electrodes of all of the pixels generally being connected to a constant DC potential (Vcom). FIG. 3 of the accompanying drawings illustrates a typical optical response of a reflective liquid crystal pixel of the display of FIGS. 1 and 2 as normalised reflectance plotted against the voltage applied between the electrodes 11 and 14. The optical response is substantially symmetrical about zero volts and, in order to provide a grey-scale display element, the pixel electrode 11 and the storage capacitor Cs may be charged to any voltage from −4 volts to +4 volts with respect to Vcom.

In order to prevent degradation of the liquid crystal material by ionic transport mechanisms, the time-averaged voltage across the liquid crystal layer should be substantially zero. For a given optical state, this may be achieved by periodically reversing the polarity of the voltage across the liquid crystal layer of each pixel, for example each time the pixel is updated or refreshed. For example, in order to display a constant optical state of approximately 50% reflectance, the pixel electrode is alternately refreshed to +1.75V and −1.75V with respect to Vcom.

All of the pixels 2 of the active matrix 1 are refreshed at a frequency known as the frame rate. As mentioned hereinbefore, refreshing of each frame of image data is typically performed on a row-by-row basis. For each row of pixels, the data line driver 4 receives a row of image data to be displayed and charges the data lines 6 to the appropriate analog voltages. The scan line driver 5 activates a scan line such that all of the TFTs 10 in the matrix row whose gates are connected to the activated scan line are switched on. The TFTs 10 transfer charges from the data lines to the storage capacitors Cs until the voltage of each capacitor is the same as the data line to which it is connected. The scan line is then deactivated and the TFTs 10 of the row of pixels return to a high impedance state. This is repeated for each row of pixels.

FIG. 4 of the accompanying drawings illustrates typical timing signals in the display of FIG. 1. The display controller 3 receives VSYNC, HSYNC and DATA signals with each vertical synchronising signal indicating the transmission of a new frame of image data and each horizontal synchronising signal indicating the transmission of a row of data. The N scan lines 7 receive the scan line signals G1-GN as shown in FIG. 4. The frame rate is given by the frequency or repetition rate of the vertical synchronising signal VSYNC and the power consumption of the active matrix 1 is substantially proportional to the frame rate.

FIG. 5 of the accompanying drawings illustrates a typical general purpose display controller suitable for use as the controller shown at 3 in FIG. 1. The controller is formed as an integrated circuit for receiving digital display signals and comprises a timing generator for receiving display clock signals DCK, horizontal synchronising signals HSYNC and vertical synchronising signals VSYNC and for controlling timing of the controller 3. A matrix 21 is provided for converting luminance and chrominance signals Y, Cr, Cb to RGB format. The controller also has inputs for receiving RGB format signals, which bypass the matrix 21.

The image data signals are supplied to an on-screen display mixer 22 which mixes the image data signals with on-screen display signals stored in a frame buffer in the form of a static random access memory (SRAM) 23. The final image data for display are supplied to a gamma correction circuit 24 which compensates for any non-linear response of the display, such as the response illustrated in FIG. 3 of the accompanying drawings. The gamma correction circuit 24 has a picture adjust input which allows the colour, brightness and tint of the image to be adjusted.

The digital output from the circuit 24 is supplied to an output of the controller for use with displays requiring digital data. However, the controller 3 also comprises a digital/analog converter (DAC) 25 and an amplifier 26 for supplying image data signals in analog format.

If on-screen display data are required, such as icons, menus and graphical features, the appropriate image data are written into the memory 23. The memory 23 typically holds only one bit per pixel so as to allow binary (as opposed to grey-scale) on-screen data display. The data in the memory 23 overwrite the image data supplied to the controller 3 so as to make the on-screen display data visible over the arbitrary image data to be displayed.

Although such an arrangement is flexible and allows complex overlay data to be displayed, such an arrangement is excessively complex when the presentation of, for example, only a few simple icons is required. Further, because the on-screen data are mixed with the image data for the whole display, updating of the overlay image data necessitates refreshing of the whole display.

SUMMARY OF THE INVENTION

According to the invention, there is provided an active matrix display comprising: an array of picture elements comprising a first set of first picture elements and at least one second set of second picture elements; a first refreshing arrangement for refreshing the first picture elements with arbitrary image data; and at least one second refreshing arrangement for refreshing the second picture elements of the second set or a respective one of the second sets with the same image data.

The first and second refreshing arrangements may be disposed at least partly at the first and second picture elements, respectively.

The display may comprise a plurality of the second sets and a plurality of the second refreshing arrangements.

The or each second refreshing arrangement may be disablable and the second pixels of the or each second set may be arranged to be refreshed by the first refreshing arrangement with arbitrary image data when the or the respective second refreshing arrangement is disabled.

Each of the first and second pixels may have a range of optical responses comprising at least three different optical responses. The same image data may correspond to an optical response at an end of the range.

Each of the first picture elements may comprise an optical element and a first semiconductor switch of the first refreshing arrangement for selectively connecting the optical element to a data line of the array.

Each of the second picture elements may comprise an optical element and a second semiconductor switch of the second refreshing arrangement for selectively connecting the optical element to receive the same image data. Each of the second picture elements may comprise a first semiconductor switch of the first refreshing arrangement for selectively connecting the optical element to a data line of the array. The first and second semiconductor switches of each of the second picture elements may have main conduction paths connected in parallel. Each of the first picture elements may comprise a third semiconductor switch having a main conduction path connected in parallel with a main conduction path of the respective first semiconductor switch. Each of the third semiconductor switches may have a control electrode connected to a control electrode of the respective first semiconductor switch. As an alternative, each of the third semiconductor switches may be arranged to be permanently switched off during operation of the display.

The at least one second refreshing arrangement may comprise means for charging data lines of the array connected to the second picture elements to the same value and the second switches may be arranged selectively to connect the optical elements of the second picture elements to the data lines. As an alternative, the second switches maybe arranged selectively to connect the optical elements to a common further data line.

The second switches of the or each second set may have control inputs connected to a common control line. As an alternative, the first switches of each row of the array may be connected to a respective scan line and each of the second picture elements may comprise a third semiconductor switch connected in series with the second switch and having a control input connected to the scan line of an adjacent row.

Each of the semiconductor switches may comprise a thin film transistor.

Each of the optical elements may comprise a variable light-attenuating element, such as a light-reflecting element. Each of the optical elements may comprise a liquid crystal element.

As an alternative, each of the optical elements may comprise a variable light-emitting element.

The display may comprise at least one second picture element arranged to be refreshed by at least two second refreshing arrangements.

The display may comprise a direct view display.

The display may comprise a controller for controlling the first and second refreshing arrangements. In a first mode of operation, the controller may enable the first refreshing arrangement and, in a second mode of operation, the controller may disable the first refreshing arrangement and enable at least one of the at least one second refreshing arrangements. The second refreshing arrangement in the second mode of operation may have a refresh rate which is less than that of the first refreshing arrangement in the first mode of operation. The same image data may correspond to an optical response at a first end of the range in the first mode of operation and a second end of the range in the second mode of operation.

The second picture elements of at least one of the at least one second set may be disposed in the shape of at least one alphanumeric character.

The second picture elements of at least some of the second sets may be disposed in the shapes of segments of at least one segmented alphanumeric character.

The second picture elements of at least one of the at least one second set may be disposed in the shape of at least one graphical feature, such as at least one symbol or icon.

At least some of the second picture elements may be disposed so as to define at least one manual inputting region of the display. The at least some picture elements may be disposed in a shape representing a keyboard. The display may include detecting means for detecting manual inputting at the or each manual inputting region.

It is thus possible to provide an arrangement in which, for example, graphical features such as icons of fixed type are effectively incorporated within a display. Such features may comprise "hard-wired" pixels which can function as standard active matrix pixels or which can be written to or overwritten with a particular state (such as maximum white or maximum black) when the feature is to be activated. The hard-wired pixels are chosen during manufacture so that displays can be customised for different applications. Individual icons or icon pixels may form segments of larger graphical features, such as animated icons or characters. Such graphical features may overlap each other. Such features may be permanent in the sense of being displayed whenever the display is enabled or may be optionally visible.

It is thus possible to provide an arrangement of reduced complexity than that for known displays. Also, graphical features such as icons may be activated by a single control signal supplied to the display. No additional display area is required and, in some embodiments, when the features are not required, they are not visible to an observer.

Updating of simple graphical data is therefore possible without requiring refreshing of the whole modulator or display. It is thus possible to achieve substantially lower power consumption. Also, such features may be the only visible features when a display is operated in a stand-by mode.

When the pixels of the graphical features are set to "extreme" optical states, the frequency of polarity changes required to avoid, for example, liquid crystal degradation may be reduced. Thus, the refresh rate of a display may be reduced, for example to allow a very low power mode of operation.

Modulators and displays of this type can easily be manufactured. For example, in order to provide a custom display, only one processing mask change may be necessary so as to customise the display in accordance with the specific user requirements.

BRIEF DESCRIPTION OF THE DRAWINGS

The invention will be further described, by way of example, with reference to the accompanying drawings, in which.

DESCRIPTION OF THE PREFERRED EMBODIMENTS

Figure 6:
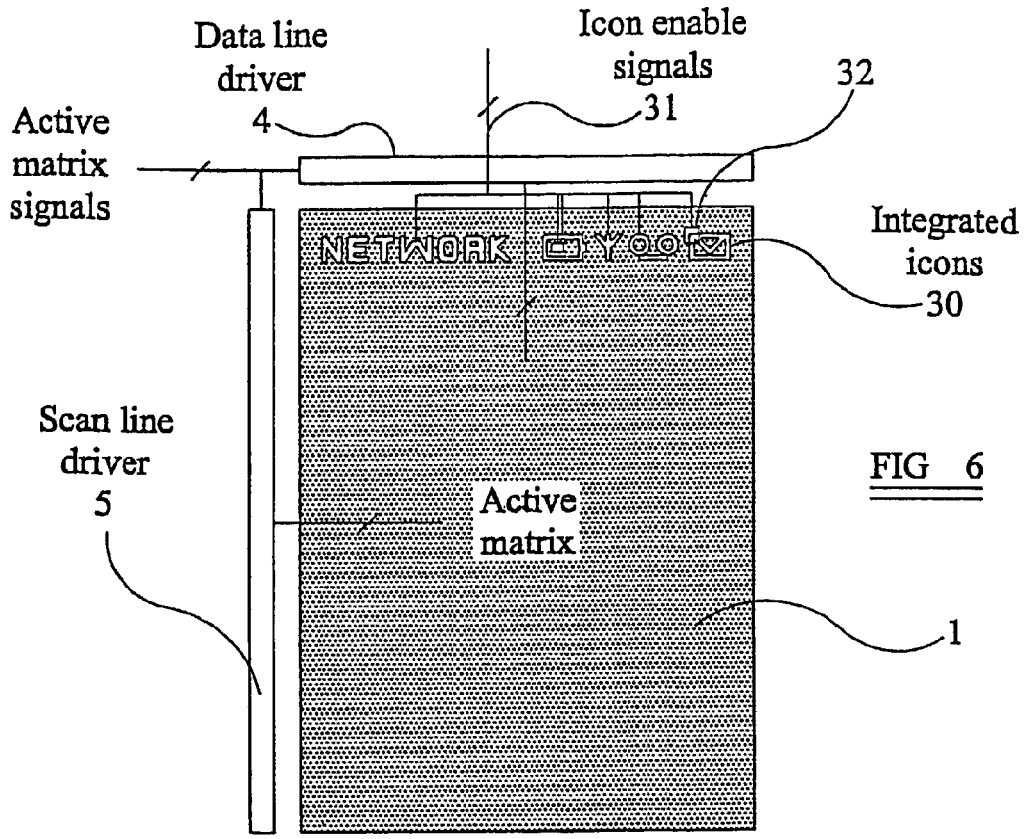
FIG. 6 is a diagram illustrating the activated state of a reflective active matrix liquid crystal display constituting a first embodiment of the invention.

FIG. 6 illustrates diagrammatically the appearance of a typical active matrix reflective liquid crystal display incorporating features in the form of icons 30 in the active matrix 1. The icons are individually selectable by means of signals on a bus 31 which is separate from the data and scan lines. One of the icons is in the form of a word "NETWORK", all of whose letters are selected by a single control signal. Another icon is in the shape of a battery but comprises two separately addressable sub-icons in the form of a battery frame and battery contents to allow the state of charge of a battery to be indicated.

The pixels of the active matrix 1 comprise a first set and a plurality of second sets. The first pixels of the first set are used in the conventional way for displaying image data supplied to the data line and scan line drivers 4 and 5 and play no part in displaying the icons 30. The second sets of pixels display the icons 30 when suitably addressed or refreshed and each second set is defined by all of the pixels which are selectable by a common enable signal.

Figure 3:
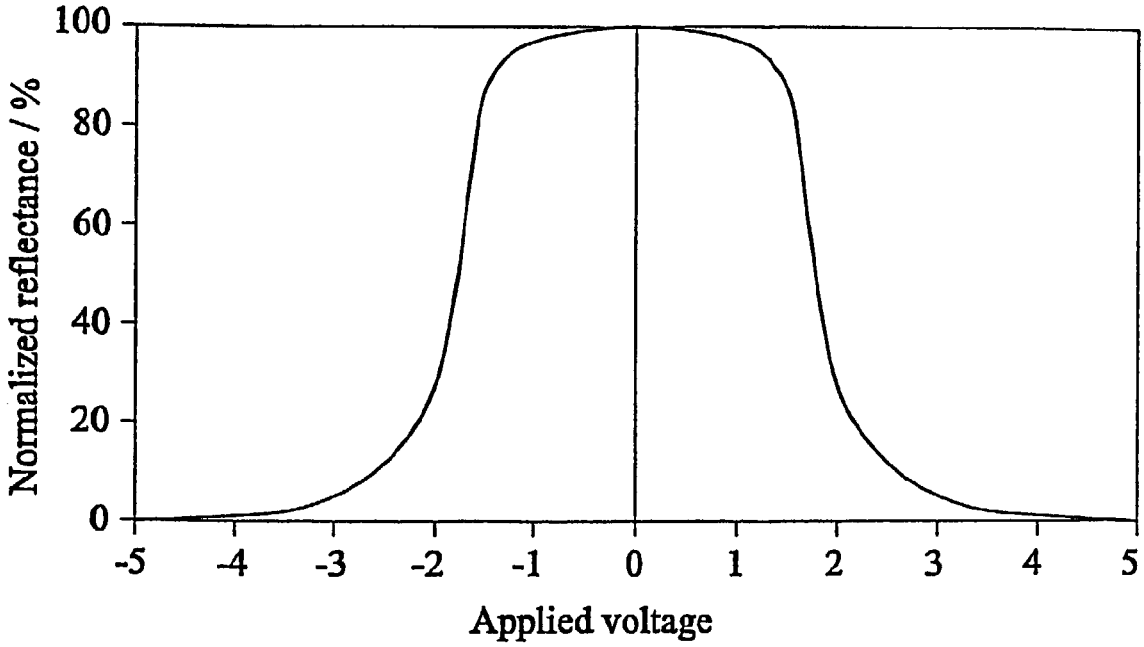
FIG 3 ( Prior art )
FIG. 3 is a graph illustrating the optical response of a pixel of FIG. 2.
Figure 4:
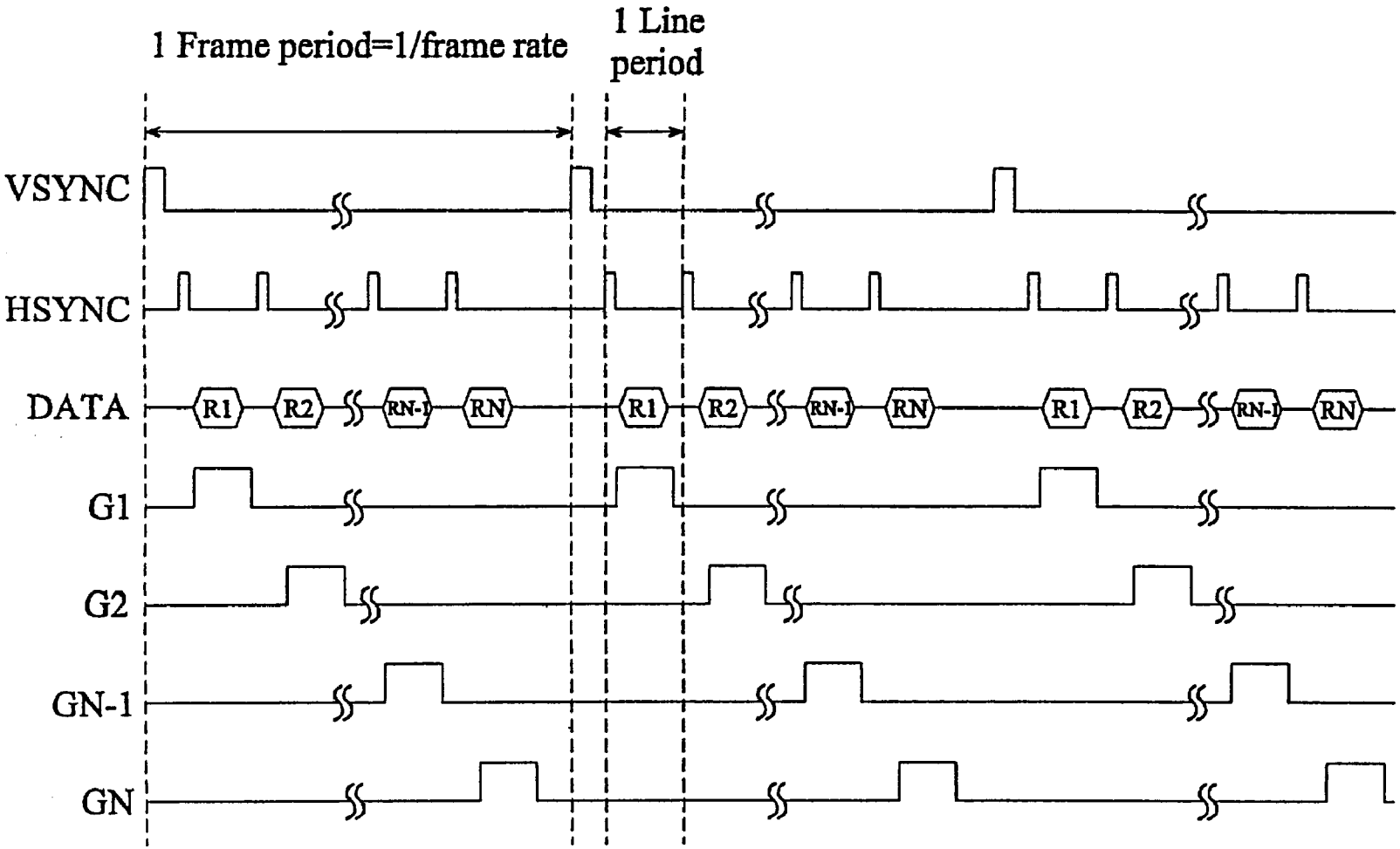
FIG 4 (Prior art)
FIG. 4 is a timing diagram illustrating waveforms appearing in the display of FIG. 1.
Figure 5:
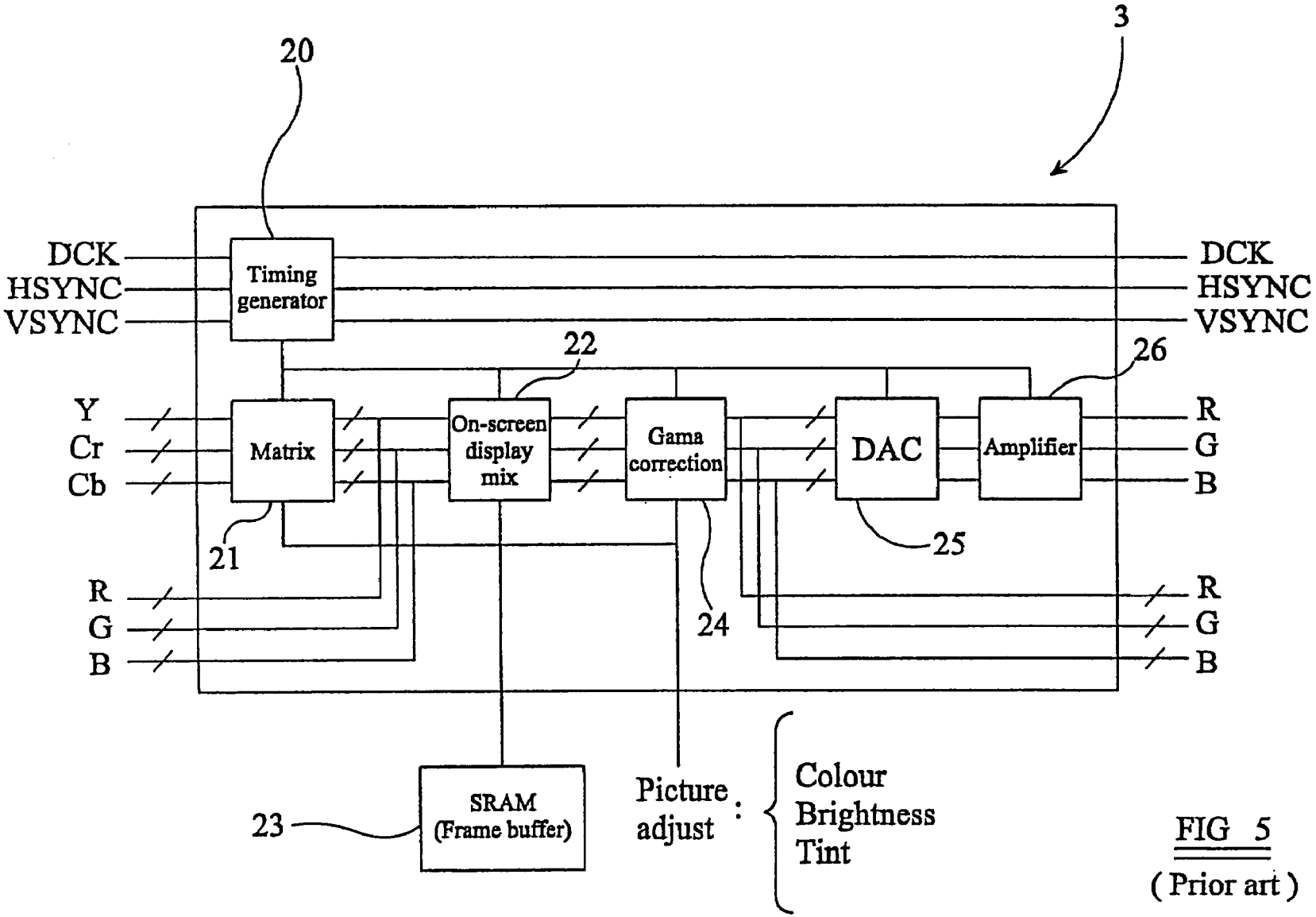
FIG 5 (Prior art)
FIG. 5 is a block circuit diagram of a display controller of the display of FIG. 1.
Figure 7:
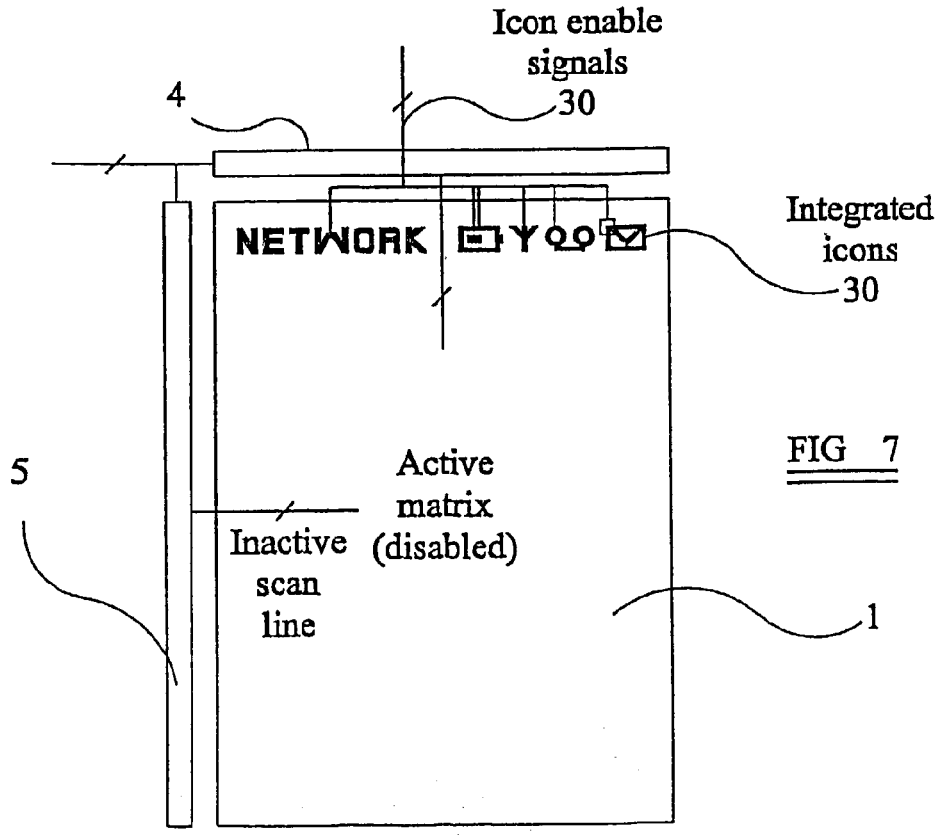
FIG. 7 is a diagram illustrating the deactivated state for a low-power stand-by mode of operation of the display shown in FIG. 6.

When image data are supplied to the display, those icons which are selected or activated appear superimposed on or overlaid on top of an image. For example, the icon pixels may be controlled so as to be in a "white" or highly reflective state so as to appear brighter than the rest of the displayed image. When no image data are supplied to the display, the default optical state is usually white or highly reflective and corresponds to the liquid crystal pixel state with no voltage across the liquid crystal layer as illustrated in FIG. 3. The icons 30 may then be controlled so as to be in a "black" or non-reflective optical state as illustrated in FIG. 7.

Activated icons do not have to be black or white and may be displayed in an intermediate grey level if required. However, all of the icon pixels of each icon are in the same optical state when the icon is activated.

The display includes a controller which, in the embodiments illustrated in the drawings, is formed within the data line driver 4 and/or the scan line driver 5. The controller controls whether the icons are displayed as black or white as described above and also controls the refresh rate of the icons when no image data are supplied to the display. In this state, the refresh rate of the icon pixels may be arranged to be substantially less than the refresh rate of the active matrix 1 when image data are being supplied. The icons thus remain visible but are refreshed at a much lower rate so as substantially to reduce the power consumption, for example in a "standby" mode of operation.

Figure 1:
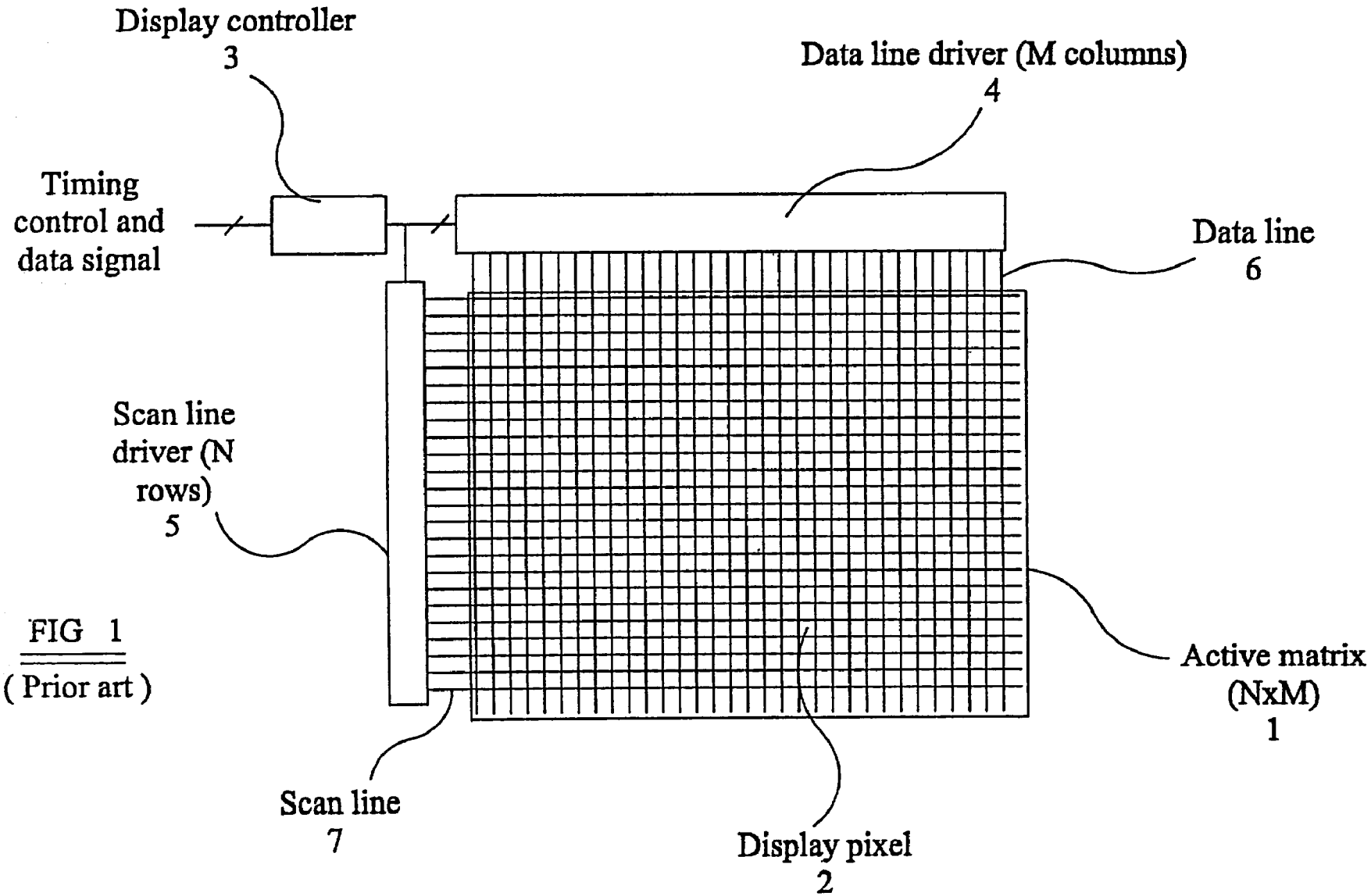
FIG 1 (Prior art)
FIG. 1 is a block schematic diagram of a known type of active matrix display.
Figure 2:
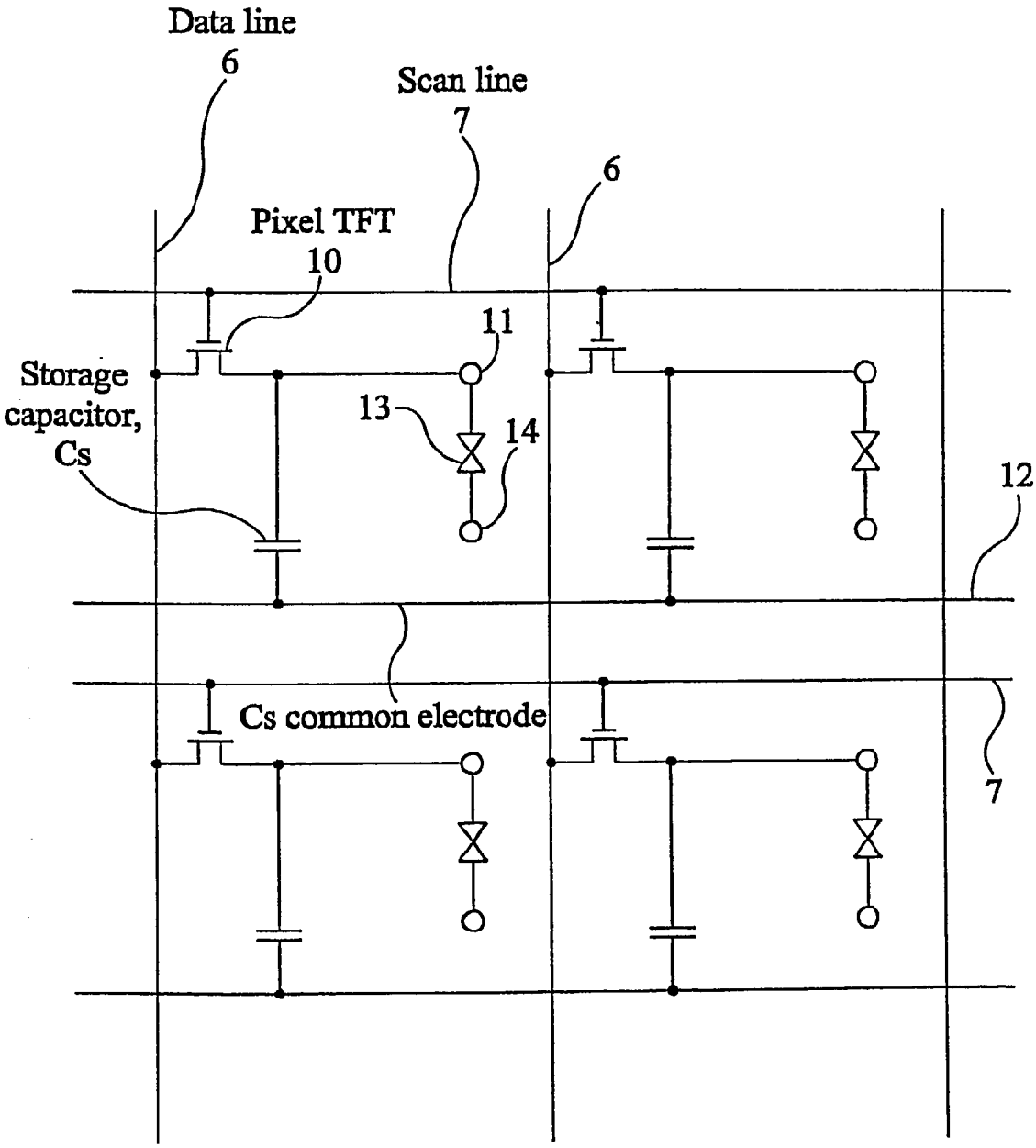
FIG 2 (Prior art)
FIG. 2 is a circuit diagram of four pixels of the display of FIG. 1.
Figure 8:
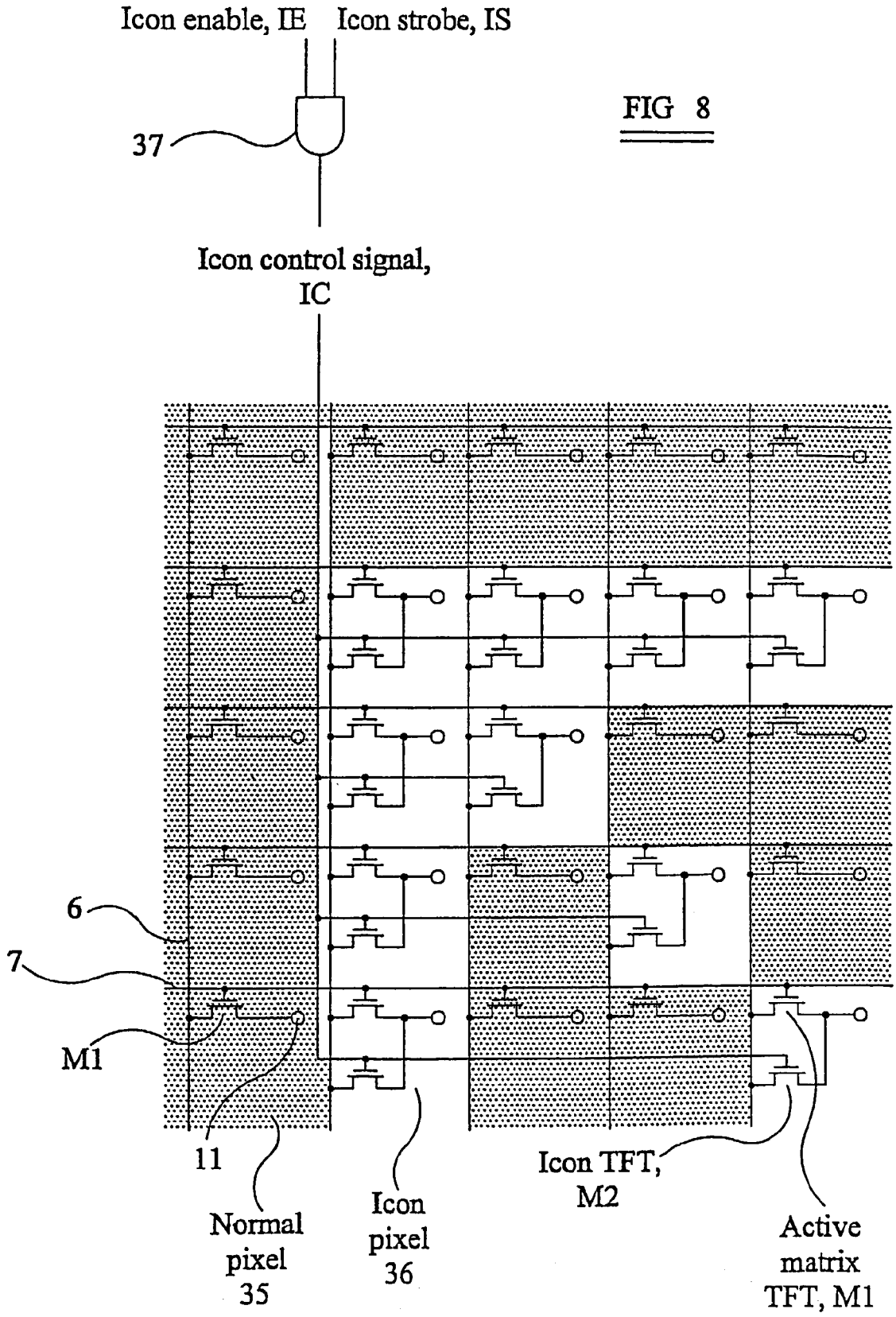
FIG. 8 is a circuit diagram of part of a display constituting a second embodiment of the invention.

In some of the subsequent figures, a small region indicated at 32 in FIG. 6 is illustrated to a larger scale and in more detail. For example, FIG. 8 illustrates 25 pixels with the pixels of the first set or "normal pixels" such as 35 being shown shaded and with the pixels of one of the second sets or "icon pixels" such as 36 being shown unshaded. The pixels are shown in simplified form omitting the liquid crystal element and storage capacitor for the sake of clarity. Thus, each of the normal pixels 35 is of the conventional active matrix type, for example as illustrated in FIG. 2, and comprises a thin film transistor (TFT) M1 whose gate is connected to the scan line 7, whose source is connected to the data line 6 and whose drain is connected to the pixel electrode 11.

Each of the icon pixels 36 also comprises the conventional active matrix TFT M1. However, in addition, each pixel 36 comprises a second TFT M2 whose source-drain path is connected in parallel with the source-drain path of the pixel transistor M1 and whose gate is connected to the gates of all of the second transistors of the pixels forming that icon to receive an icon control signal IC from an AND gate 37. The gate 37 has a first input for receiving an icon enable IE and a second input for receiving an icon strobe IS.

When the icon is not required to be visible, the icon enable and strobe signals are low and the second transistors M2 of the icon pixels 36 remain switched off or in a high impedance state. The icon pixels 36 thus function in exactly the same way as the normal pixels 35 and are addressed and refreshed in the same way with image data presented on the data lines 6 and scanned onto the electrodes 11 a row at a time by scan signals on the scan lines 7. The icon pattern defined by the icon pixel locations within the active matrix is thus unobservable.

Figure 9:
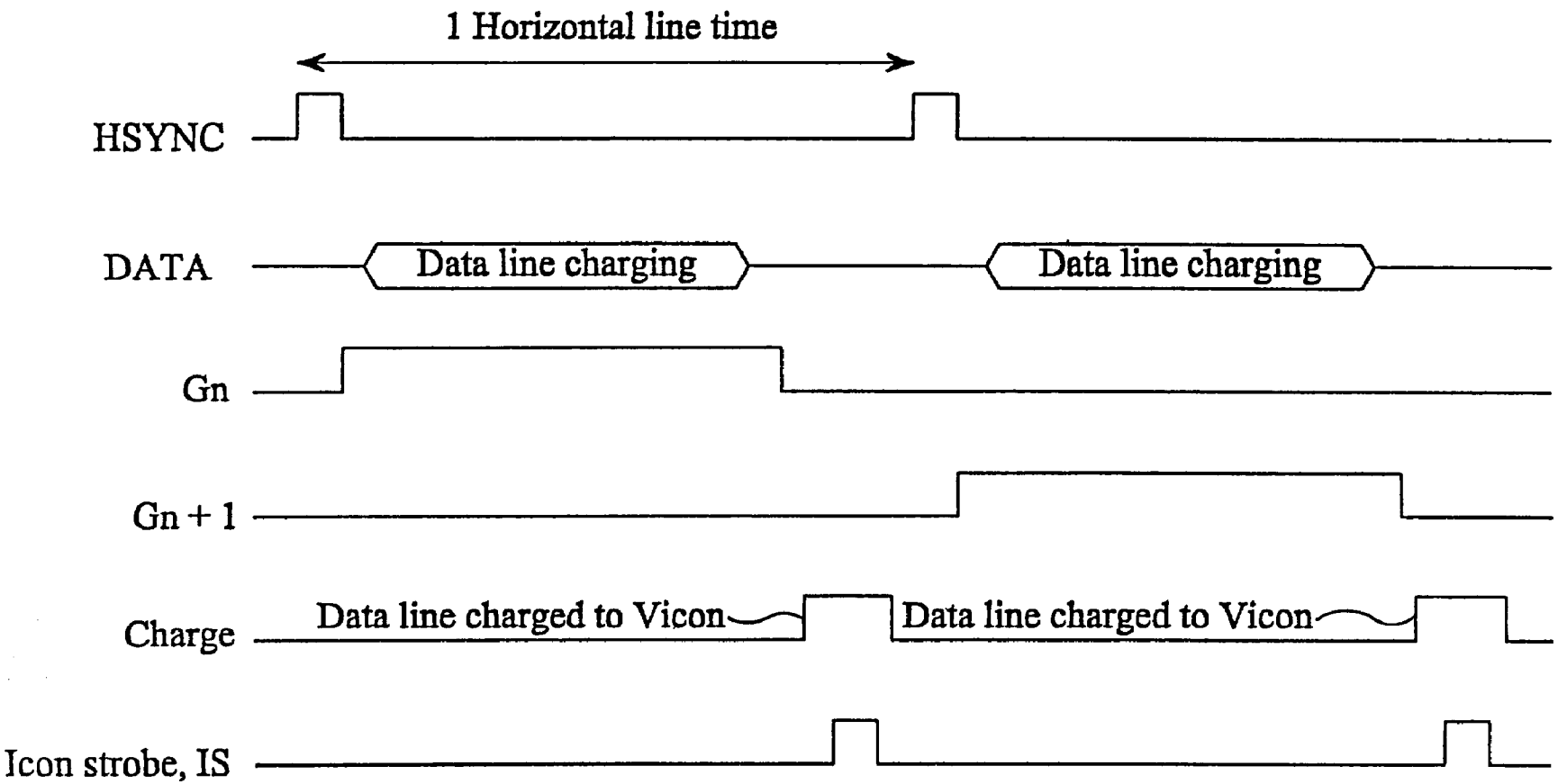
FIG. 9 is a timing diagram illustrating waveforms occurring in the display illustrated in FIG. 8.

When the icon is required to be observable, the icon enable goes high and the icon control signal is activated when the icon strobe signal goes high. Refreshing of the display with the icon visible is illustrated by the waveform diagram of FIG. 9. The icon strobe signal IS is active towards the end of each line time.

The arrival of an HSYNC pulse indicates the start of transmission of a new line of data for display. The row of image data is clocked into the data line driver and is converted to the appropriate analog voltages which are supplied to the data lines. While the scan line voltage Gn for the nth line of the display is high, the transistors M1 of all of the pixels of the row being scanned are switched on. The data line voltages are thus applied to the pixel electrodes and are stored in the storage capacitors so as to be held at the pixels after the scan line has become inactive and the transistors M1 of the row of pixels have been switched off or returned to their high impedance state. After the Nth scan line has become inactive, all of the data lines or at least those data lines connected to the icon pixels 36 are charged to a voltage Vicon for setting the icon pixels into the same specific optical state, for example fully reflective/white or fully non-reflective/black. This is illustrated by the "Charge" waveform in FIG. 9. The icon strobe IS goes high during this period so that all of the icon transistors M2 of all of the icon pixels are switched on to transfer the voltage Vicon onto the pixel electrodes and storage capacitors of the icon pixels 36. During this phase, all of the transistors M1 of all of the pixels remain switched off. Image data transferred to the icon pixels 36 of the nth row are overwritten so as to have the optical state defined by the voltage Vicon.

In order to avoid degradation of the liquid crystal of the icon pixels 36, the voltage Vicon alternates between being positive and negative with respect to the voltage of the common or counter electrode. The alternation may be on a line by line basis, a frame by frame basis, or at a lower frequency and ensures that the time-averaged voltage across the liquid crystal of the icon pixels 36 is substantially zero.

Figure 10:
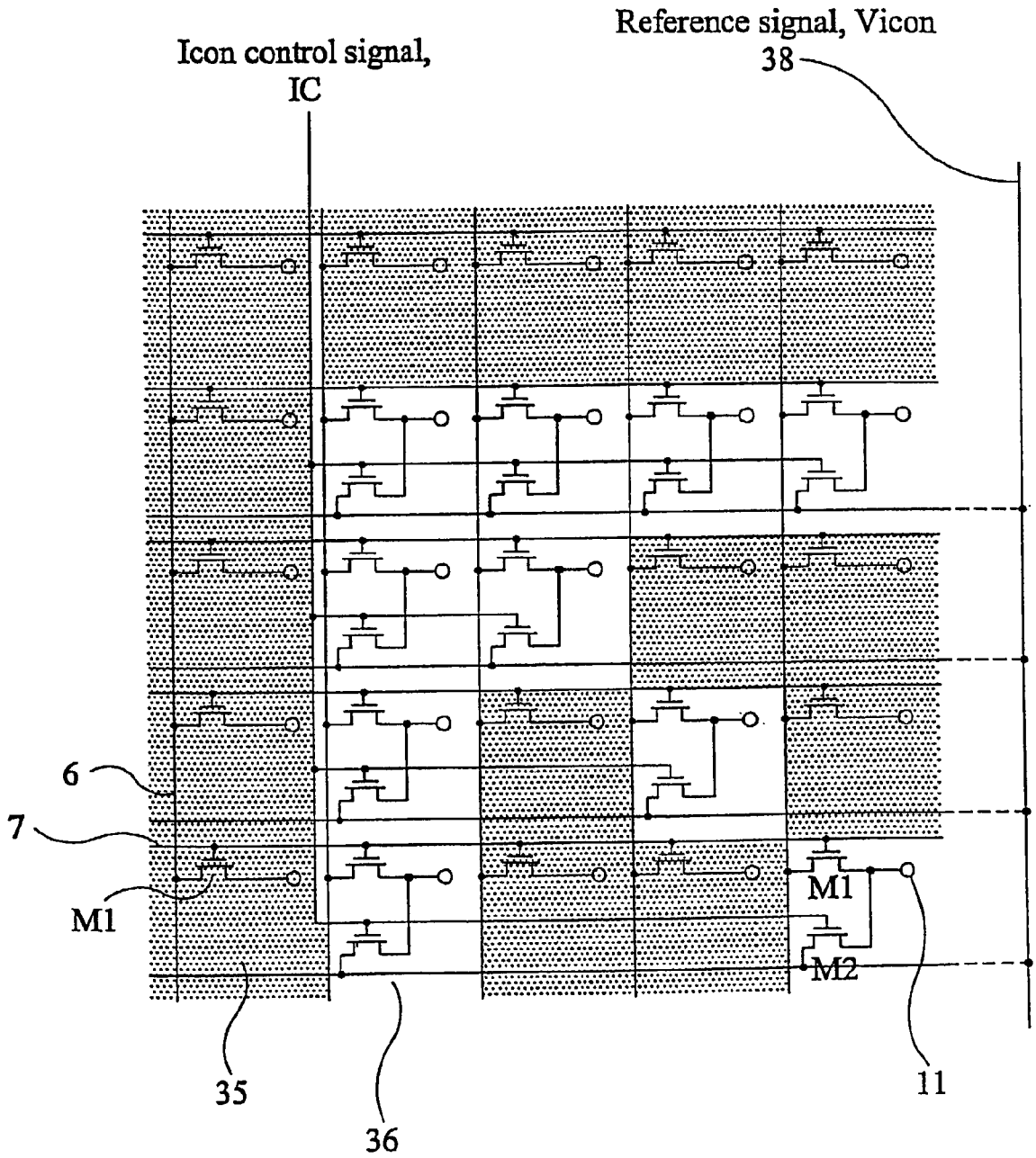
FIG. 10 is a circuit diagram of part of a display constituting a third embodiment of the invention.

The display shown in FIG. 10 differs from that shown in FIG. 8 in that the sources of the transistors M2 of the icon pixels 36 are connected to a common reference signal line 38 instead of to the data lines. It is not therefore necessary to charge the data lines to the icon pixel voltage Vicon and this allows the icon pixels 36 to be strobed once per frame.

Figure 11:
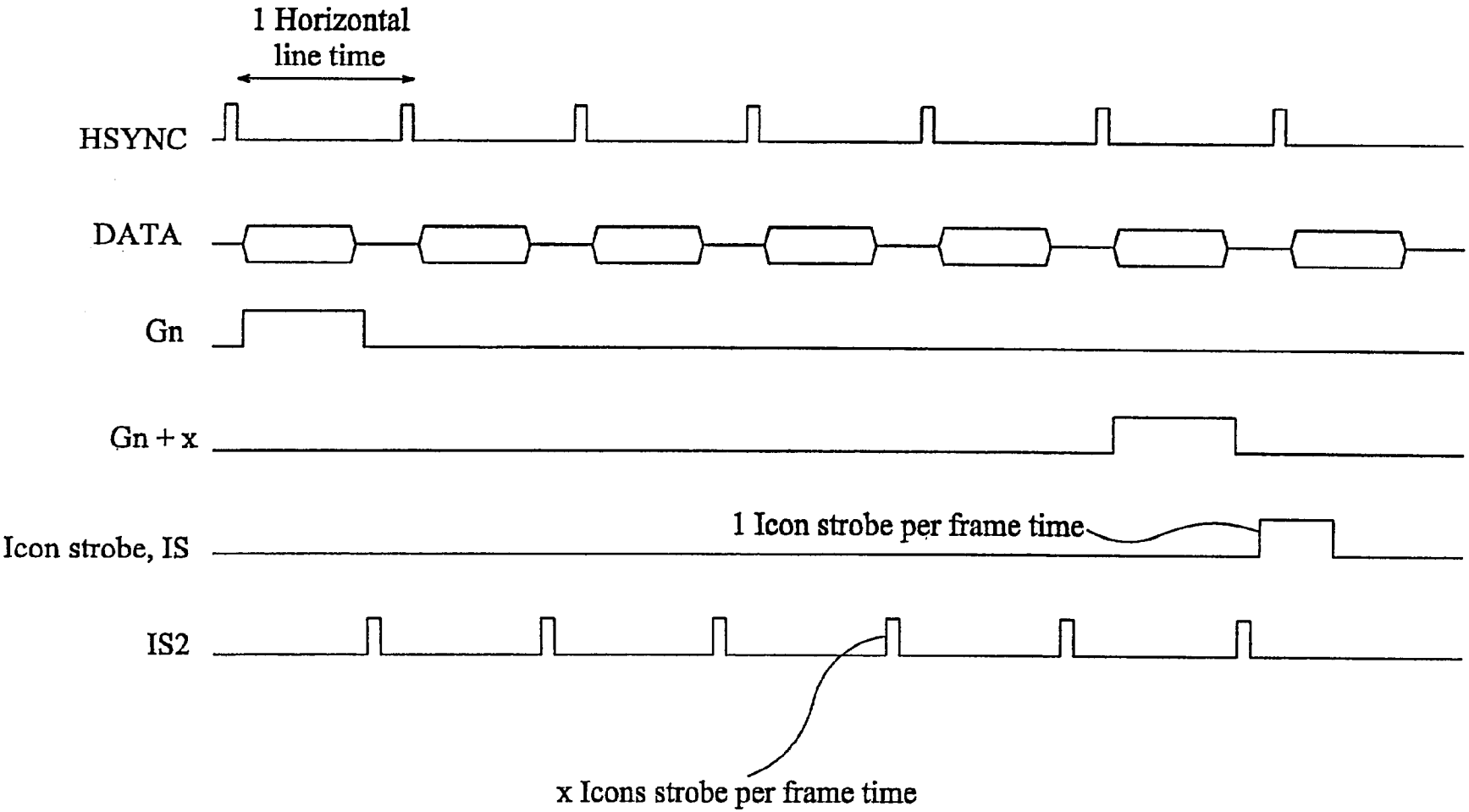
FIG. 11 is a timing diagram illustrating waveforms occurring in the display illustrated in FIG. 10.

The waveform diagram of FIG. 11 illustrates the waveforms occurring in the display of FIG. 10 and shows two different icon strobes IS and IS2. It is assumed that the icon pixels 36 span x rows of the display from the row n to the row n+x. As described with reference to FIGS. 8 and 9, the icon pixels 36 first receive image data in accordance with the row by row scanning of the transistors M1. After the n+x row is scanned by the scanning signal Gn+x, the icon strobe IS is activated so that the transistors M2 of the icon pixels 36 connect the pixel electrodes and storage capacitors to the common reference signal line 38. The icon pixels are therefore overwritten with the icon reference voltage Vicon if the icon enable signal is active. Conversely, if the icon enable signal is inactive, the icon pixels are not overwritten and the icon is unobservable.

Using the icon strobe IS means that, for a fraction of the frame time approximately equal to x/N, activated icon pixels are not programmed with the correct voltage. If the icons are relatively large such that x is relatively large, this may result in undesirable artefacts being visible in the icon pixels 36. In such a case, the alternative icon strobe IS2 may be used and strobes all of the icon pixels after the horizontal line time for each of the rows n to n+x.

Figure 12:
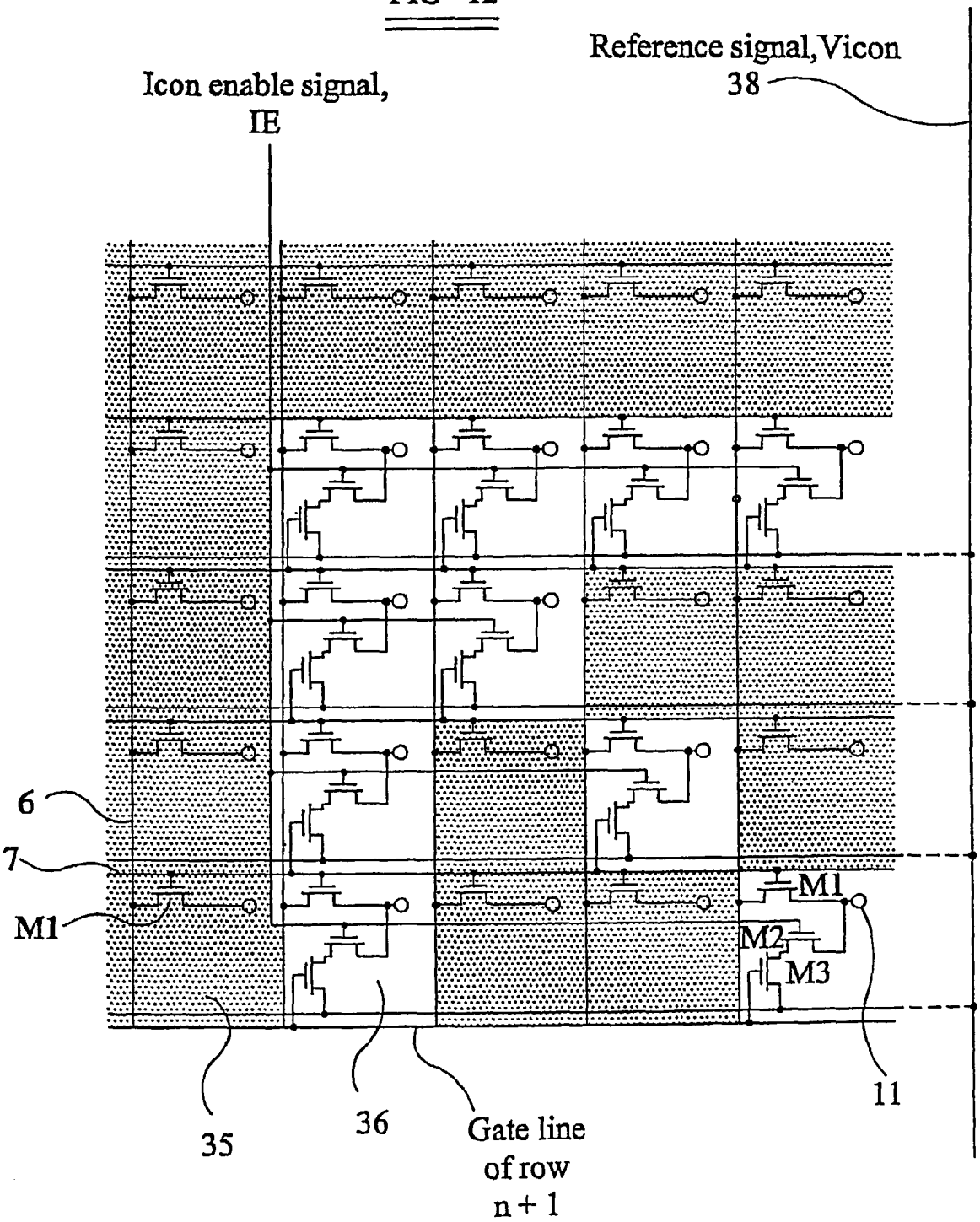
FIG. 12 is a circuit diagram of part of a display constituting a fourth embodiment of the invention.

The display of FIG. 12 differs from that of FIG. 10 in that the icon pixels 36 do not require a separate icon strobe. Thus, the control signal supplied to the icon pixels is the icon enable signal IE.

In order to achieve this, each of the icon pixels 36 comprises a third thin film transistor M3 whose source-drain path is connected in series with the source-drain path of the transistor M2. The gates of the transistors M3 in each row, such as row n, are connected to the scan line 7 of the following row, such as row n+1 which receives the scan pulse following the scan pulse for the row n.

In this display, the icon pixels 36 in each row are refreshed with image data at the same time as the normal pixels 35 in the same row. Assuming that the icon enable signal IE is high so that the transistors M2 of all of the icon pixels 36 are conductive, when the next scan pulse is supplied, the transistors M3 of the icon pixels 36 in the row which has just be refreshed are switched on so that the pixel electrode 11 and the storage capacitor are connected to the reference signal line 38 and the icon pixels of that row are overwritten with the optical state defined by the reference signal Vicon.

Figure 13:
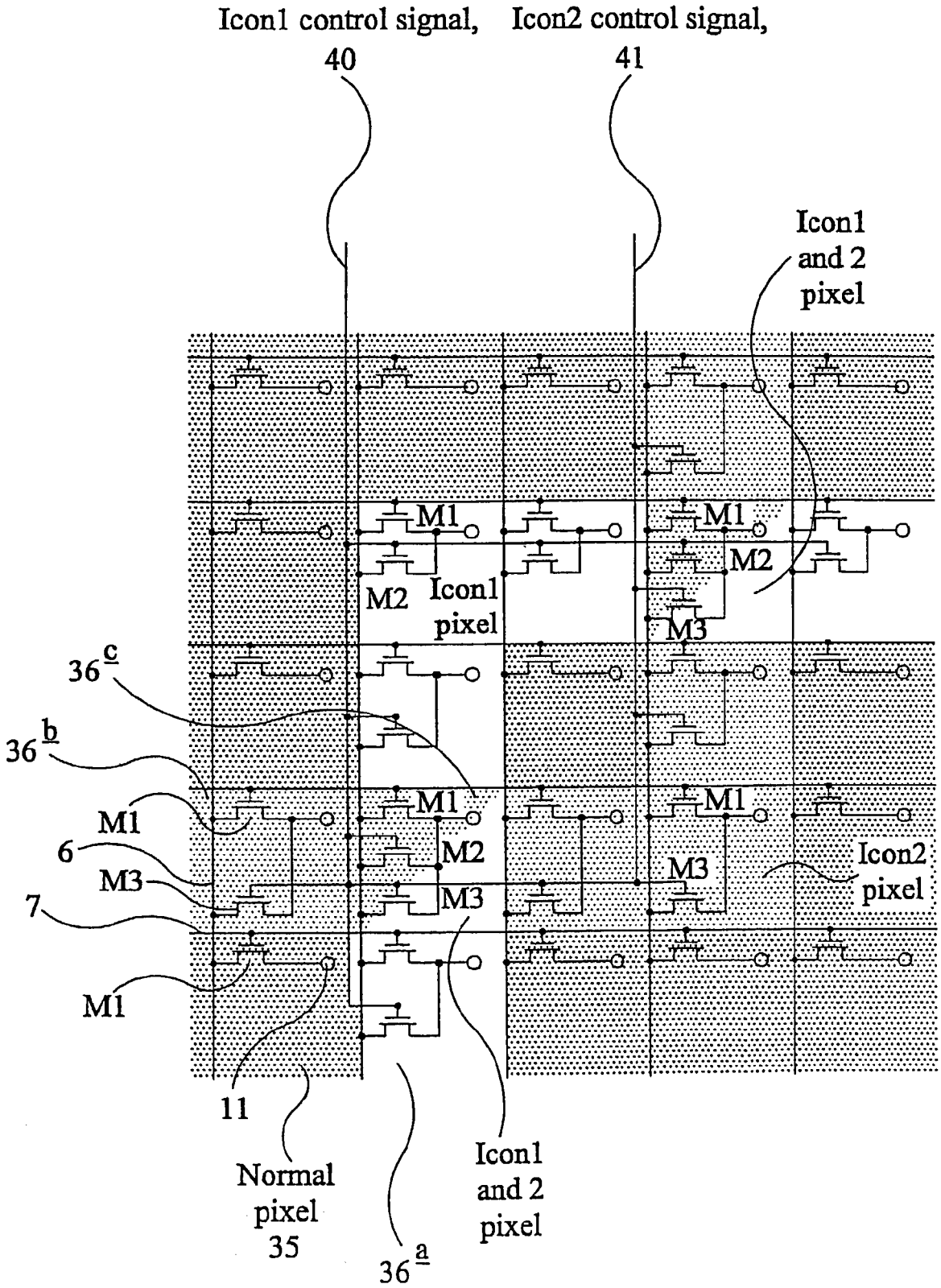
FIG. 13 is a circuit diagram of part of a display constituting a fifth embodiment of the invention.

The display shown in FIG. 13 is of the same type as that shown in FIG. 8 but differs in that it comprises icon pixels such as 36*a* of a first icon, icon pixels 36*b* of a second icon, and icon pixels 36*c* which are common to the first and second icons. The pixels of the second icon are shown more lightly shaded than the normal pixels 35 and the pixels 36*c* which are common to the first and second icons are shown half shaded and half unshaded.

The normal pixels 35 and the first icon pixels 36*a* are identical to the pixels 35 and 36, respectively, shown in FIG. 8 and operate in the same way with a first icon control signal supplied to a control line 40. Similarly, the second icon pixels 36*b* are identical to the first icon pixels 36*a* but have a transistor labelled M3 instead of the transistor labelled M2 with the gates of all of the transistors M3 being connected to a second icon control signal line 41.

Each icon pixel 36*c* which is common to both the first icon and the second icon has a transistor M2 whose gate is connected to the first icon control signal line 40 and a transistor M3 whose gate is connected to the second icon control signal line 41.

When both icons are disabled, the display functions as a conventional active matrix display with all of the pixels being refreshed with image data on a row by row basis. When the first icon is enabled, the control signal line 40 goes high with the timing illustrated in FIG. 9 so that the icon pixels 36*a* and 36*c* are overwritten with the icon reference voltage but the pixels 36*b* which are exclusive to the second icon are not overwritten. Conversely, when the second icon is enabled and the first icon is disabled, the pixels 36*b* and 36*c* are overwritten. When both icons are enabled, all of the pixels 36*a*, 36*b* and 36*c* are overwritten.

Figure 14A:
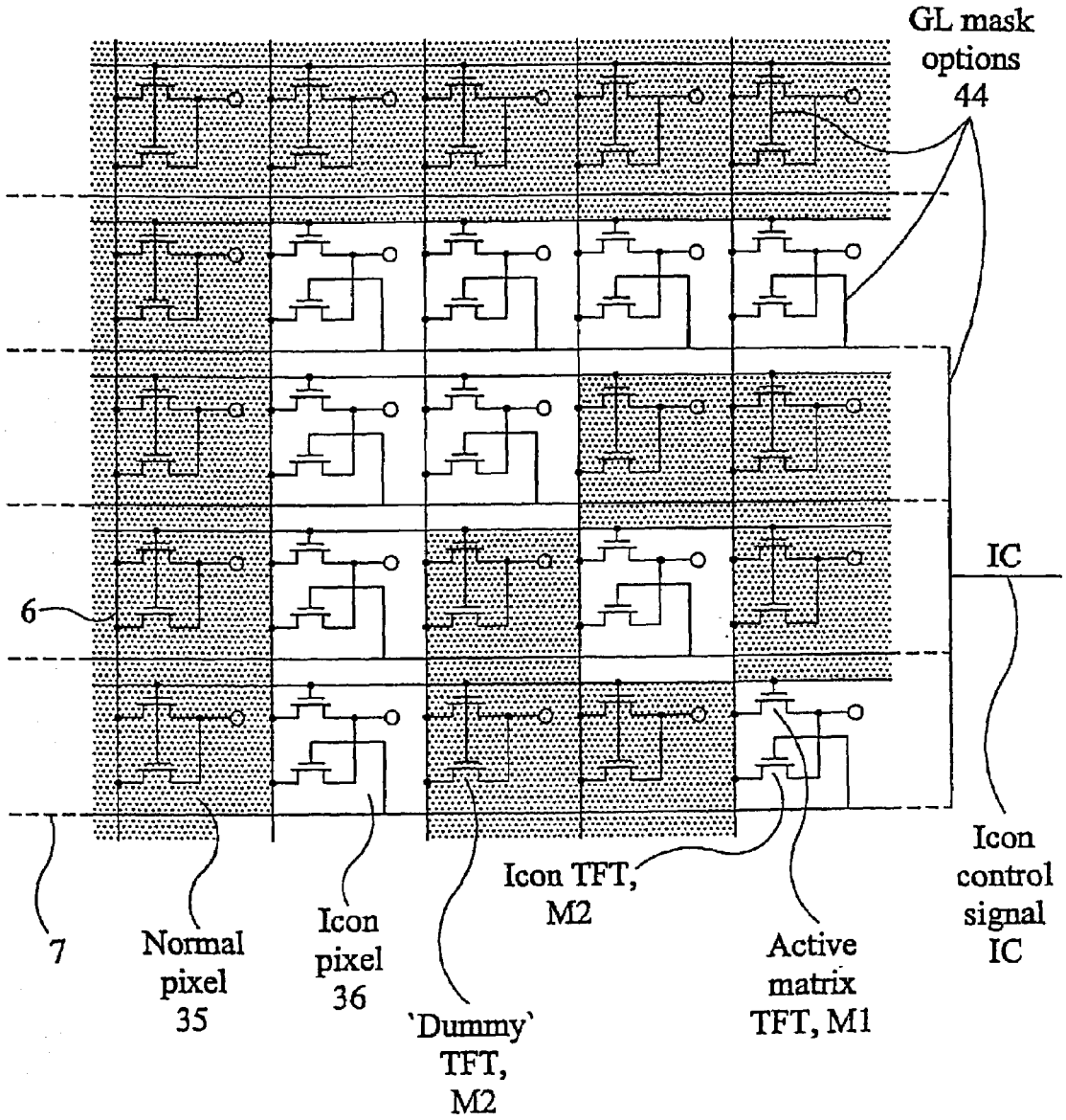
FIGS. 14*a* and *b* are circuit diagrams of part of a display constituting sixth and seventh embodiments of the invention.

The display shown in FIG. 14*a* is of the same type as that shown in FIG. 8 but differs in that each of the normal pixels 35 comprises a "dummy" transistor M2 corresponding to the transistors M2 of the icon pixels 36 but with its gate connected to the gate of the transistor M1 of the same pixel. Thus, all of the pixels of the display shown in FIG. 14*a* have essentially the same circuit topologies with the normal pixels 35 and the icon pixels 36 differing only in the gate connection of the transistors M2. This ensures that the optical performances of the normal pixels 35 and the icon pixels 36 when the icon is deactivated are substantially perfectly matched and can not be visibly distinguished from each other, for example as a result of transistor parasitic elements. With the gates of the transistors M2 of the normal pixels 35 connected to the gates of the transistors M1, the transistors M1 and M2 of each normal pixel 35 turn on and off together in synchronism.

Figure 14B:
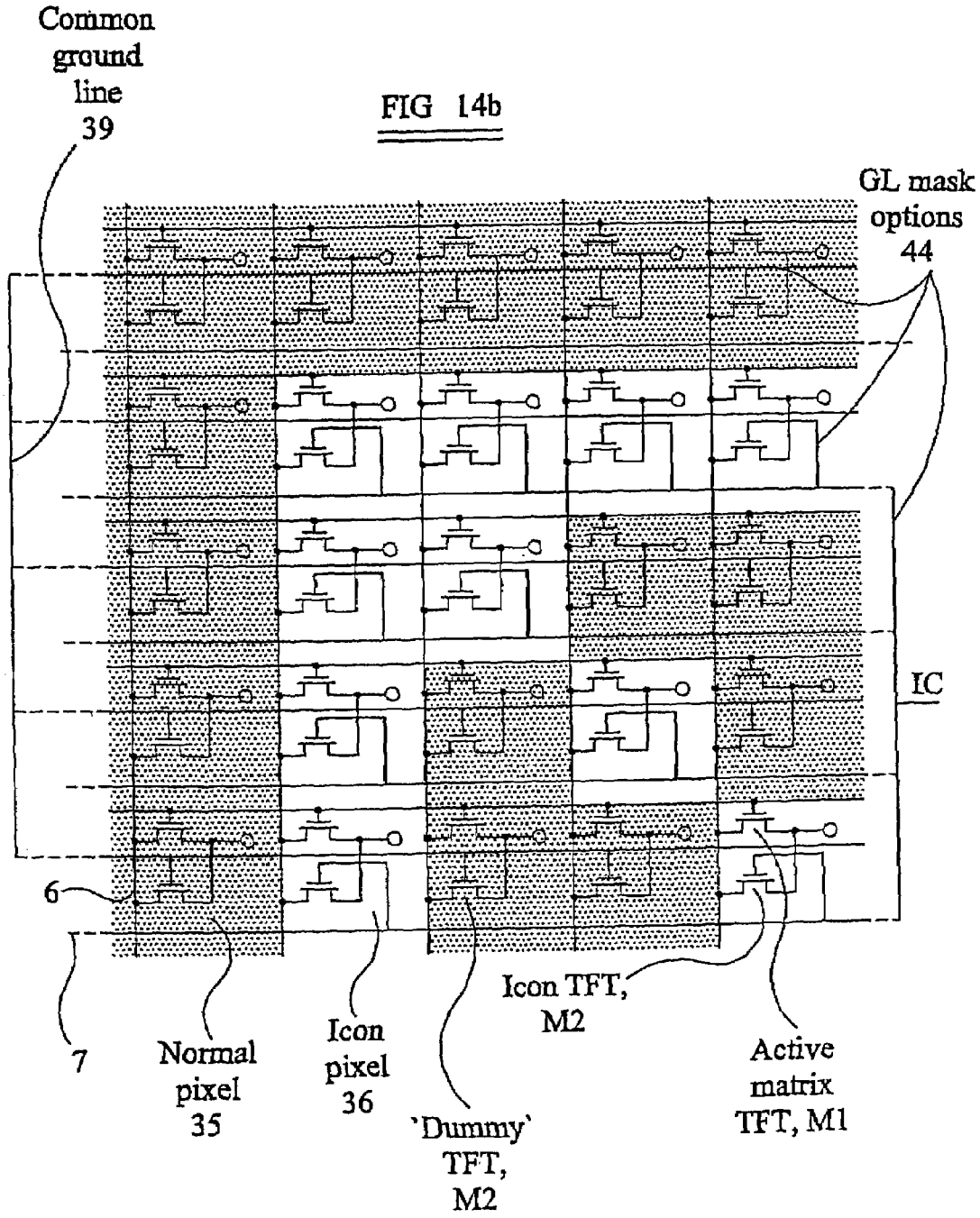

FIG. 14*b* illustrates a display which differs from that of FIG. 14*a* in that the gate of the transistor M2 of each normal pixel 35 is connected to a permanent "ground", such as the common electrode of the matrix, by a common ground line 39. Thus, the transistors M2 of all of the normal pixels 35 are permanently switched off. The presence of these "dummy" transistors in both embodiments has substantially no electrical effect or undesirable visible effect on the operation of the display.

The displays of FIGS. 14*a* and *b* allow display customisation during manufacture to be completed with a minimum number of processing mask changes. In particular, the gate metal processing layer (GL) is the only layer which defines whether a pixel is an icon pixel or a normal pixel. The relevant connections which vary depending on the role of each pixel are highlighted by thickened lines and some are indicated at 44 in FIGS. 14*a* and *b*. Thus, a manufacturer can conveniently customise active matrix displays merely by modifying the GL mask during manufacture since all of the other processing masks are the same irrespective of the icon features which are required to be present.

Figure 15:
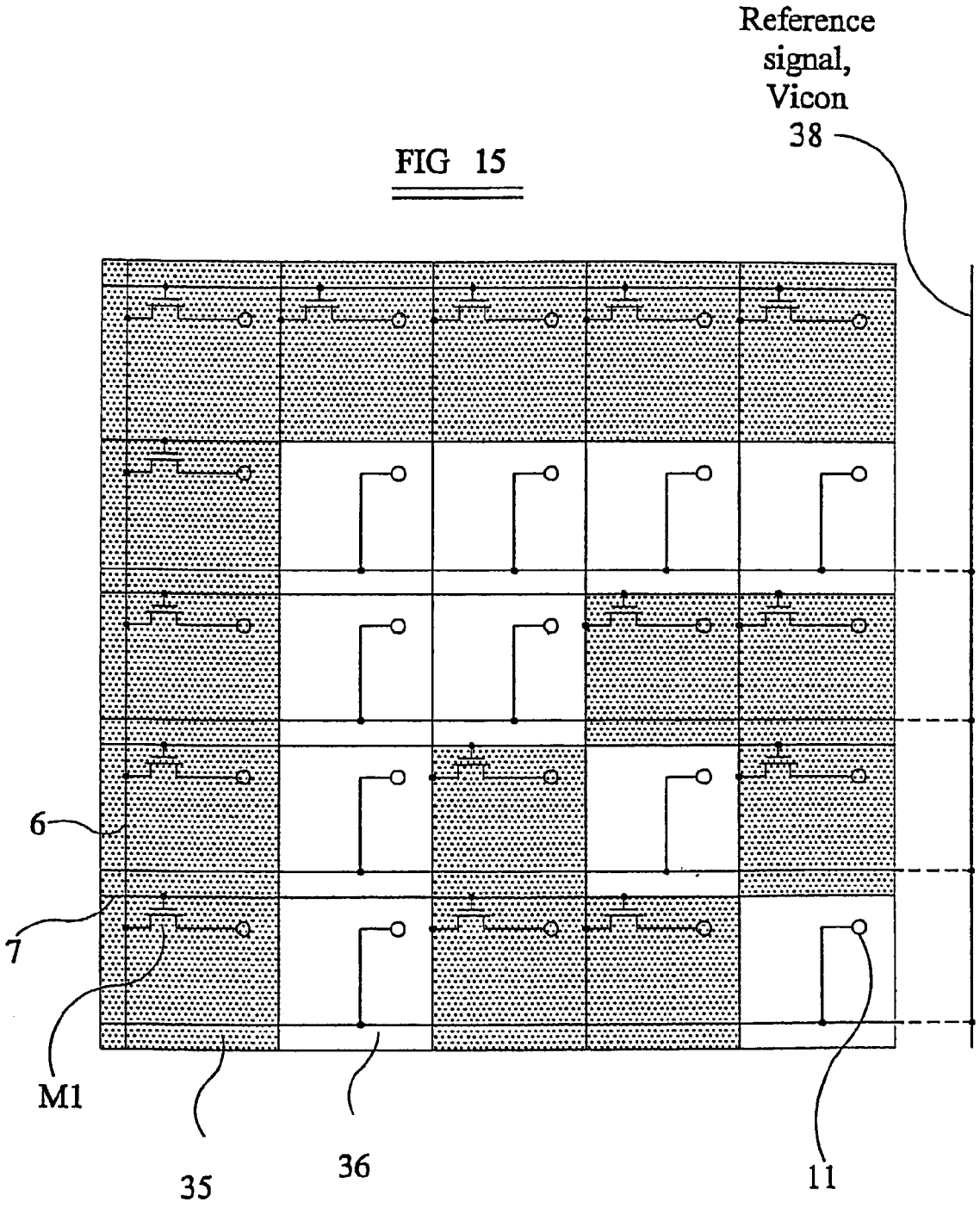
FIG. 15 is a circuit diagram of part of a display constituting an eighth embodiment of the invention.

The displays illustrated in FIGS. 8 to 14*b* are all capable of disabling the or each icon so that each icon pixel may function conventionally as part of an active matrix display receiving arbitrary image data. FIG. 15 shows a display which differs from this in that the icon pixels 36 are not capable of being updated or refreshed by the standard active matrix signals so that the icon pixels 36 permanently display the or each icon. The icon pixels 36 are therefore greatly simplified in that the pixel electrode 11 is directly connected to the reference signal line 38 and the transistors M1 and M2 are omitted from the icon pixels. The icon pixels 36 do not, therefore, require a control signal and are not refreshed in the same way as for the display of FIG. 10. Instead, the alternating polarity reference signal Vicon may be thought of as performing the refreshing of the icon data. The icons are therefore permanently displayed but may, for example, form useful portions of larger animated icons.

Figure 16:
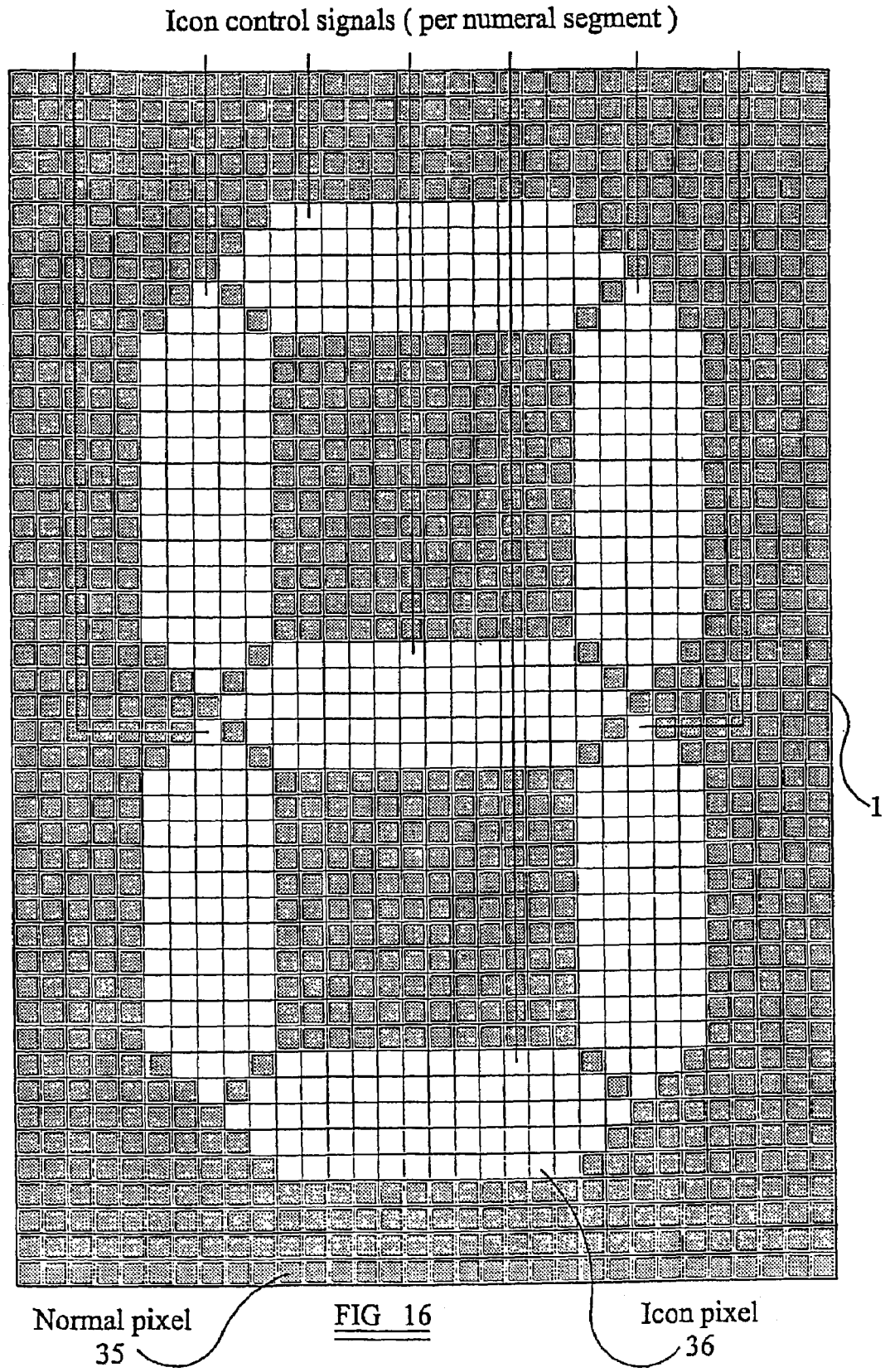
FIG. 16 illustrates the use of a display according to any of the embodiments of the invention for providing a seven segment image display.

FIG. 16 illustrates a display arranged to provide a larger graphical feature in the form of a compound icon comprising several separately addressable icon components or sub-icons. The graphical feature illustrated in FIG. 16 is a seven segment numeric character and the individual icon components can be separately addressed so that the display can provide an image representing any of the digits 0 to 9. A display of this type may, for example, be used to display several such characters, for example to provide a low power display of the time of day when the rest of the active matrix 1 is disabled to save power.

Figure 17:
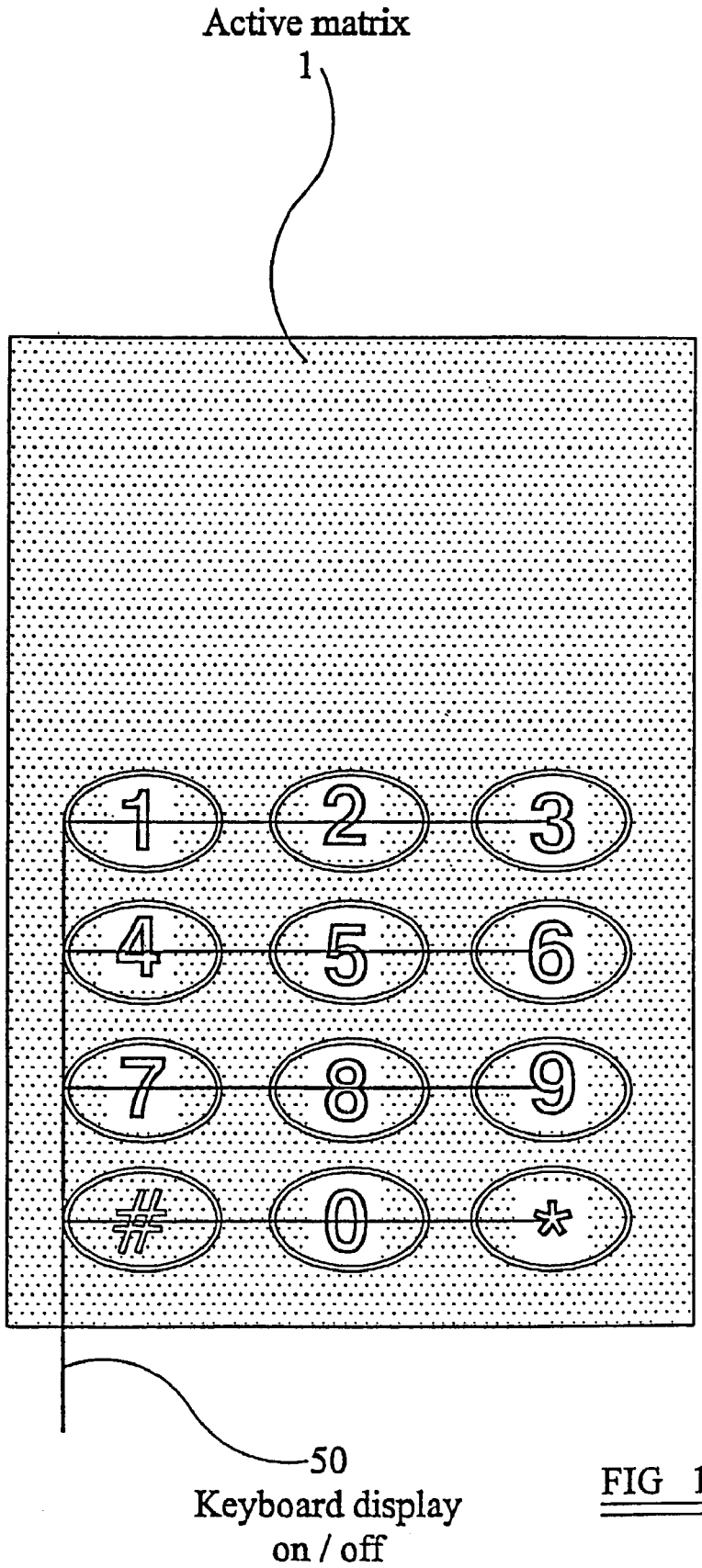
FIG. 17 illustrates the use of a display according to any of the embodiments of the invention for displaying a numeric keyboard.

FIG. 17 illustrates a display including a numeric keyboard icon controlled by a single icon control signal line 50 so that display of the whole keyboard icon can be switched on or off. At least the region of the display containing the keyboard icon may be used in conjunction with a touch or pen or other pointer sensitive input arrangement, for example in the form of a resistive tablet input device overlaid on top of the display, to allow numeric entry, for example to provide "dialling" of telephone numbers. The keyboard icon may be activated only when the input arrangement is active, such an arrangement may form part of what is generally known as a "touchscreen".

The displays constituting embodiments of the invention and described hereinbefore are all of the liquid crystal active matrix type in which the "pixel switches" or transistors are implemented by amorphous silicon thin film transistors. However, such displays may be fabricated in other ways, for example with low temperature poly-silicon thin film transistors. The displays may be transmissive, reflective or transreflective but, in the case of reflective or transreflective displays, the additional pixel transistors do not interfere with the pixel aperture ratio. Other applicable types of displays are those with thin film diode switching elements and emissive pixel displays such as organic electroluminescent displays.

Such displays allow simple graphical data to be updated or refreshed without requiring refreshing of the whole active matrix when only the graphical data are to be displayed. Thus, display power consumption can be substantially reduced and this is particularly advantageous in displays for portable battery operated equipment.

What is claimed is:

1. An active matrix display comprising: an array of picture elements comprising a first set of first picture elements and at least one second set of second picture elements; a first refreshing arrangement for refreshing the first picture elements with arbitrary first image data supplied via data line and scan line drivers coupled to the array; and at least one second refreshing arrangement for refreshing the second picture elements of the second set or a respective one of the second sets with constant image data which is predetermined wherein the or each second refreshing arrangement may be disabled and the second pixels of the or each second set are arranged to be refreshed by the first refreshing arrangement with arbitrary image data when the or the respective second refreshing arrangement is disabled.

2. A display as claimed in claim 1, in which the first and second refreshing arrangements are disposed at least partly at the first and second picture elements, respectively.

3. A display as claimed in claim 1, comprising a plurality of the second sets and a plurality of the second refreshing arrangements.

4. A display as claimed in claim 3, in which the second picture elements of at least some of the second sets are disposed in the shapes of segments of at least one segmented alphanumeric character.

5. A display as claimed in claim 1, in which each of the first and second picture elements has a range of optical responses comprising at least three different optical responses.

6. A display as claimed in claim 5, in which the constant image data correspond to an optical response at an end of the range.

7. A display as claimed in claim 1, in which each of the first picture elements comprises an optical element and a first semiconductor switch of the first refreshing arrangement for selectively connecting the optical element to a data line of the array.

8. A display as claimed in claim 7, in which each of the first picture elements comprises a third semiconductor switch having a main conduction path connected in parallel with a main conduction path of the respective first semiconductor switch.

9. A display as claimed in claim 8, in which each of the third semiconductor switches has a control electrode connected to a control electrode of the respective first semiconductor switch.

10. A display as claimed in claim 8, in which each of the third semiconductor switches is arranged to be permanently switched off during operation of the display.

11. A display as claimed in claim 7, in which each of the semiconductor switches comprises a thin film transistor.

12. A display as claimed in claim 11, in which each of the thin film transistors comprises a low temperature polysilicon thin film transistor.

13. A display as claimed in claim 7, in which each of the optical elements comprises a variable light-attenuating element.

14. A display as claimed in claim 13, in which each of the optical elements comprises a light-reflecting element.

15. A display as claimed in claim 13, in which each of the optical elements comprises a liquid crystal element.

16. A display as claimed in claim 7, in which each of the optical elements comprises a variable light-emitting element.

17. A display as claimed in claim 1, in which each of the second picture elements comprises an optical element and a second semiconductor switch of the second refreshing arrangement for selectively connecting the optical element to receive the constant second image data.

18. A display as claimed in claim 17, in which each of the second picture elements comprises a first semiconductor switch of the first refreshing arrangement for selectively connecting the optical element to a data line of the array.

19. A display as claimed in claim 18, in which the first and second semiconductor switches of each of the second picture elements have main conduction paths connected in parallel.

20. A display as claimed in 17, in which the at least one second refreshing arrangement comprises means for charging data lines of the array connected to the second picture elements to a constant predefined value and the second switches are arranged selectively to connect the optical elements of the second picture elements to the data lines.

21. A display as claimed in claim 17, in which the second switches are arranged selectively to connect the optical elements to a common further data line.

22. A display as claimed in claim 17, in which the second switches of the or each second set have control inputs connected to a common control line.

23. A display as claimed in claim 17, in which the first switches of each row of the array are connected to a respective scan line of the scan line driver and each of the second picture elements comprises a fourth semiconductor switch connected in series with the second switch and having a control input connected to the scan line of an adjacent row of the scan line driver.

24. A display as claimed in claim 1, comprising at least one second picture element arranged to be refreshed by at least two second refreshing arrangements.

25. A display as claimed in claim 1, comprising a direct view display.

26. A display as claimed in claim 1, comprising a controller for controlling the first and second refreshing arrangements.

27. A display as claimed in claim 26, in which, in a first mode of operation, the controller enables the first refreshing arrangement and, in a second mode of operation, the controller disables the first refreshing arrangement and enables at least one of the at least one second refreshing arrangement.

28. A display as claimed in claim 27, in which the second refreshing arrangement in the second mode of operation has a refresh rate which is less than that of the first refreshing arrangement in the first mode of operation.

29. A display as claimed in claim 27, in which the constant image data correspond to an optical response at a first end of the range in the first mode of operation and a second end of the range in the second mode of operation.

30. A display as claimed in claim 1, in which the second picture elements of at least one of the at least one second set are disposed in the shape of at least one alphanumeric character.

31. A display as claimed in claim 1, in which the second picture elements of at least one of the at least one second set are disposed in the shape of at least one graphical feature.

32. A display as claimed in claim 31, in which the at least one graphical feature comprises at least one symbol or icon.

33. A display as claimed in claim 1, in which at least some of the second picture elements are disposed so as to define at least one manual inputting region of the display.

34. A display as claimed in claim 33, in which the at least some second picture elements are disposed in a shape representing a keyboard.

35. A display as claimed in claim 33, including detecting means for detecting manual inputting at the or each manual inputting region.

36. A display as claimed in claim 1, wherein the predetermined constant image data for each of the respective second picture elements has a same value.

* * * * *